US009579815B2

(12) United States Patent
Newell et al.

(10) Patent No.: US 9,579,815 B2
(45) Date of Patent: Feb. 28, 2017

(54) IN-LINE PUNCHING MACHINE

(71) Applicant: ACCO Brands Corporation, Lake Zurich, IL (US)

(72) Inventors: James R. Newell, Vernon Hills, IL (US); Dayakar Thoddu Chandrasekaran, Waukegan, IL (US); Richard McCallion, Glencoe, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 353 days.

(21) Appl. No.: 14/137,872

(22) Filed: Dec. 20, 2013

(65) Prior Publication Data

US 2015/0174780 A1 Jun. 25, 2015

(51) Int. Cl.

| | |
|---|---|
| ***B26D 5/28*** | (2006.01) |
| ***B26D 1/06*** | (2006.01) |
| ***B26D 11/00*** | (2006.01) |
| ***B26F 1/24*** | (2006.01) |

(52) U.S. Cl.

CPC ..... *B26D 5/28* (2013.01); *B26D 11/00* (2013.01); *B26F 1/24* (2013.01); *Y10T 83/0505* (2015.04); *Y10T 83/0524* (2015.04); *Y10T 83/145* (2015.04); *Y10T 83/541* (2015.04)

(58) Field of Classification Search

CPC ... B26D 5/28; B26D 5/26; B26D 1/06; B26D 1/065; B26D 11/00; Y10T 83/541; Y10T 83/543; Y10T 83/544; Y10T 83/0505; Y10T 83/0524; Y10T 83/145; B26F 1/24

See application file for complete search history.

(56) References Cited

U.S. PATENT DOCUMENTS 4,874,958 A 10/1989 Sampath et al.
5,146,824 A 9/1992 Lajoie
(Continued)

FOREIGN PATENT DOCUMENTS

JP 4-105895 * 4/1992 ..... B26D 7/01
JP 04105895 A 4/1992

OTHER PUBLICATIONS

Combined Search and Examination Report for United Kingdom Patent Appl. No. 1415313.4 dated Feb. 26, 2015, 6 pages.

*Primary Examiner* — Stephen Choi
*Assistant Examiner* — Evan MacFarlane
(74) *Attorney, Agent, or Firm* — Michael Best & Friedrich LLP

(57) ABSTRACT

A material punching machine includes a guide member defining a material pathway for transporting a piece of material through the machine. The machine also includes a first sensor element disposed adjacent the material pathway for detecting a first position of a trailing edge of the material as the material moves through the material pathway. The machine also includes a second sensor element disposed adjacent the material pathway for detecting a second position of the trailing edge of the material as the material moves through the material pathway. The machine also includes a punch element that punches a first aperture in the piece of material in a first area of the piece of material based on detection of the trailing edge by the first sensor, and punches a second aperture in another area of the piece of material based on detection of the trailing edge by the second sensor.

23 Claims, 10 Drawing Sheets

(56) References Cited

U.S. PATENT DOCUMENTS

| | | | | |
|---|---|---|---|---|
| 5,239,904 | A * | 8/1993 | Yamaguchi | B26D 5/08 83/210 |
| 5,669,277 | A | 9/1997 | Perrone | |
| 6,065,383 | A * | 5/2000 | Takaishi | B26D 5/007 83/368 |
| 6,622,908 | B2 | 9/2003 | Fukumoto et al. | |
| 6,682,285 | B2 | 1/2004 | Trovinger et al. | |
| 6,869,010 | B2 | 3/2005 | Morson | |
| 7,500,669 | B2 | 3/2009 | Mandel | |
| 7,607,660 | B2 | 10/2009 | Inoue | |
| 7,789,385 | B2 | 9/2010 | Knight | |
| 8,011,649 | B2 | 9/2011 | Yahata et al. | |
| 8,205,815 | B2 | 6/2012 | Cai et al. | |
| 8,291,802 | B2 | 10/2012 | Baba | |
| 8,298,640 | B2 | 10/2012 | Cattacin et al. | |
| 8,308,158 | B2 | 11/2012 | Hirota | |
| 8,328,187 | B2 | 12/2012 | Yasumoto | |
| 2003/0121382 | A1* | 7/2003 | Morson | B26F 1/0092 83/55 |
| 2005/0105989 | A1 | 5/2005 | Crudo | |
| 2008/0236351 | A1* | 10/2008 | Hidaka | B26D 5/34 83/73 |
| 2008/0308987 | A1 | 12/2008 | Iguchi et al. | |
| 2009/0100976 | A1* | 4/2009 | Taguchi | B26D 5/02 83/628 |
| 2010/0037738 | A1 | 2/2010 | Kobayashi et al. | |
| 2011/0200341 | A1 | 8/2011 | Moriya | |
| 2012/0133093 | A1 | 5/2012 | Saito | |
| 2012/0262765 | A1* | 10/2012 | Saito | B65H 7/08 358/488 |
| 2012/0267846 | A1 | 10/2012 | Nakada et al. | |
| 2012/0301198 | A1 | 11/2012 | Momiyama et al. | |

* cited by examiner

IN-LINE PUNCHING MACHINE

BACKGROUND

The present invention relates to in-line punching machines, and specifically to paper punching machines.

Paper punching machines are commonly coupled to a printer, such as an office printer. The paper punching machines are used to punch apertures into one or more sheets of paper that have passed from the printer to the paper punching machine. The paper punching machines typically include a specialized punching tool (e.g., a die) that punches the apertures, a guide member defining a paper pathway, and rollers that guide pieces of paper through the paper pathway.

SUMMARY

In accordance with one construction, a material punching machine includes a guide member defining a material pathway for transporting a piece of material through the machine. The machine also includes a first sensor element disposed adjacent the material pathway for detecting a first position of a trailing edge of the piece of material as the piece of material moves through the material pathway. The machine also includes a second sensor element disposed adjacent the material pathway for detecting a second position of the trailing edge of the piece of material as the piece of material moves through the material pathway. The machine also includes a punch element configured to punch a first aperture in the piece of material in a first area of the piece of material based on detection of the trailing edge by the first sensor, and to punch a second aperture in another area of the piece of material based on detection of the trailing edge by the second sensor.

In accordance with another construction, a paper punching machine includes a U-shaped guide member including a first member, a second member, and a set of rollers, the first and second members defining a material pathway therebetween for transporting a piece of paper along a direction of travel. The rollers are sized and configured to engage the piece of paper to transport the piece of paper through the guide member. The machine also includes a first sensor element disposed adjacent the material pathway for detecting a trailing edge of the piece of paper a first time as the piece of paper moves through the material pathway, the first sensor element including a plurality of sensors arranged in a row perpendicular to the direction of travel. The machine also includes a second sensor element disposed adjacent the material pathway for detecting the trailing edge of the piece of paper a second time as the piece of paper moves through the material pathway. The machine also includes a punch element including a plurality of punch pins sized and configured to punch a first set of apertures in the piece of paper in a middle portion of the piece of paper based on detection of the trailing edge by the first sensor, and to punch a second set of apertures in the piece of paper adjacent the trailing edge based on detection of the trailing edge by the second sensor.

In accordance with another construction, a method of operating a punching machine includes directing a piece of material through a material pathway in the machine, detecting a trailing edge of the piece of material a first time with a first sensor disposed adjacent the material pathway, punching a first set of apertures into the piece of material based on detection of the trailing edge with the first sensor, detecting the trailing edge of the piece of material a second time with a second sensor disposed adjacent the material pathway, and punching a second set of apertures in the piece of material based on detection of the trailing edge with the second sensor.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-13 illustrate a material punching machine 10. The machine 10 is used to punch a plurality of apertures into a sheet of paper or other material as the material passes through the machine 10. The machine 10 may be used with and coupled to a variety of devices, such as a printing device (e.g., an office printer), to add apertures into one or more sheets of material that have passed from the device and into the machine 10. The machine 10 may be used in-line or off-line (e.g., by adding a separate feeder).

Figure 1:
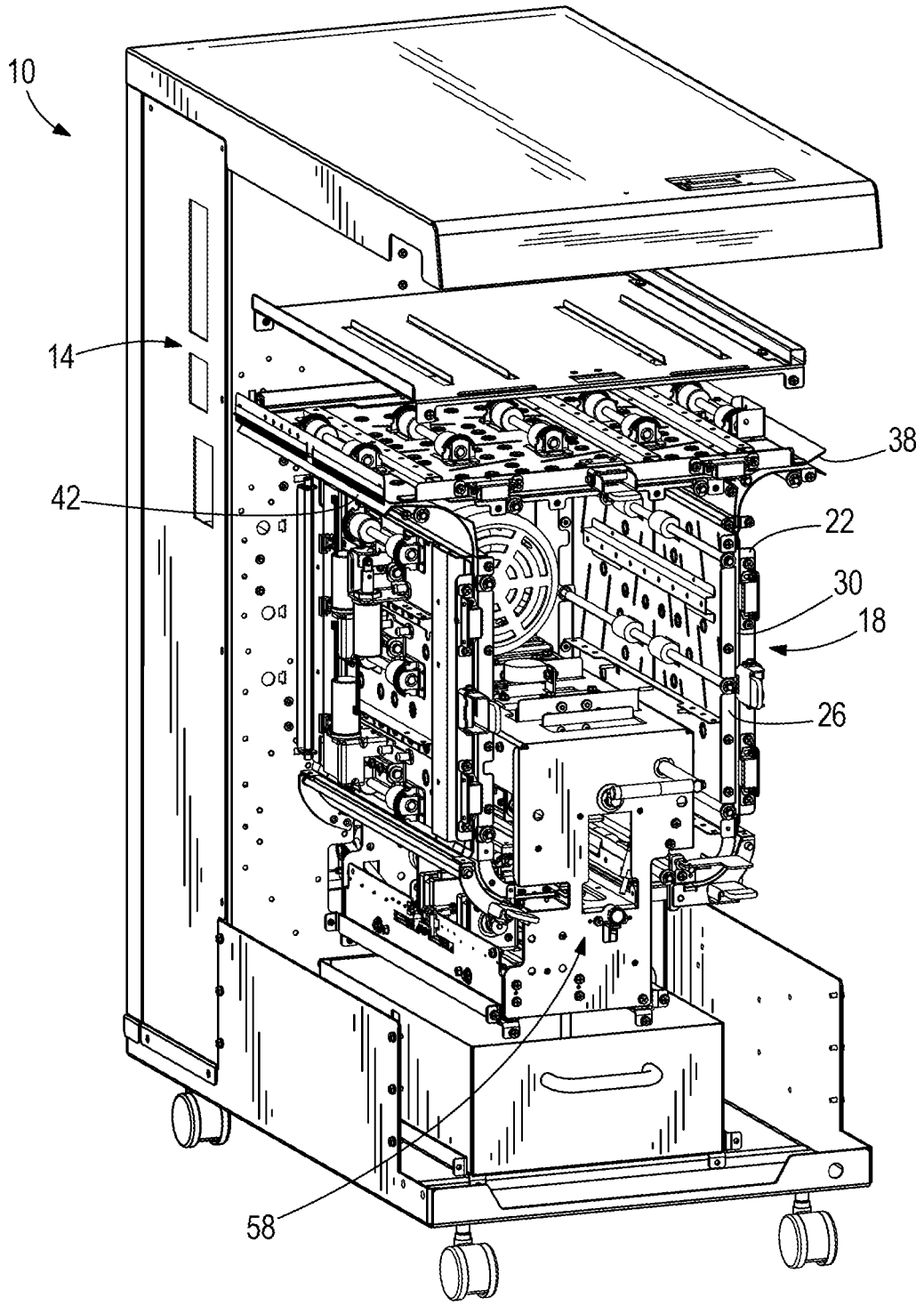
FIG. 1 is a partial perspective view of a material punching machine according to one construction of the invention.
Figure 2:
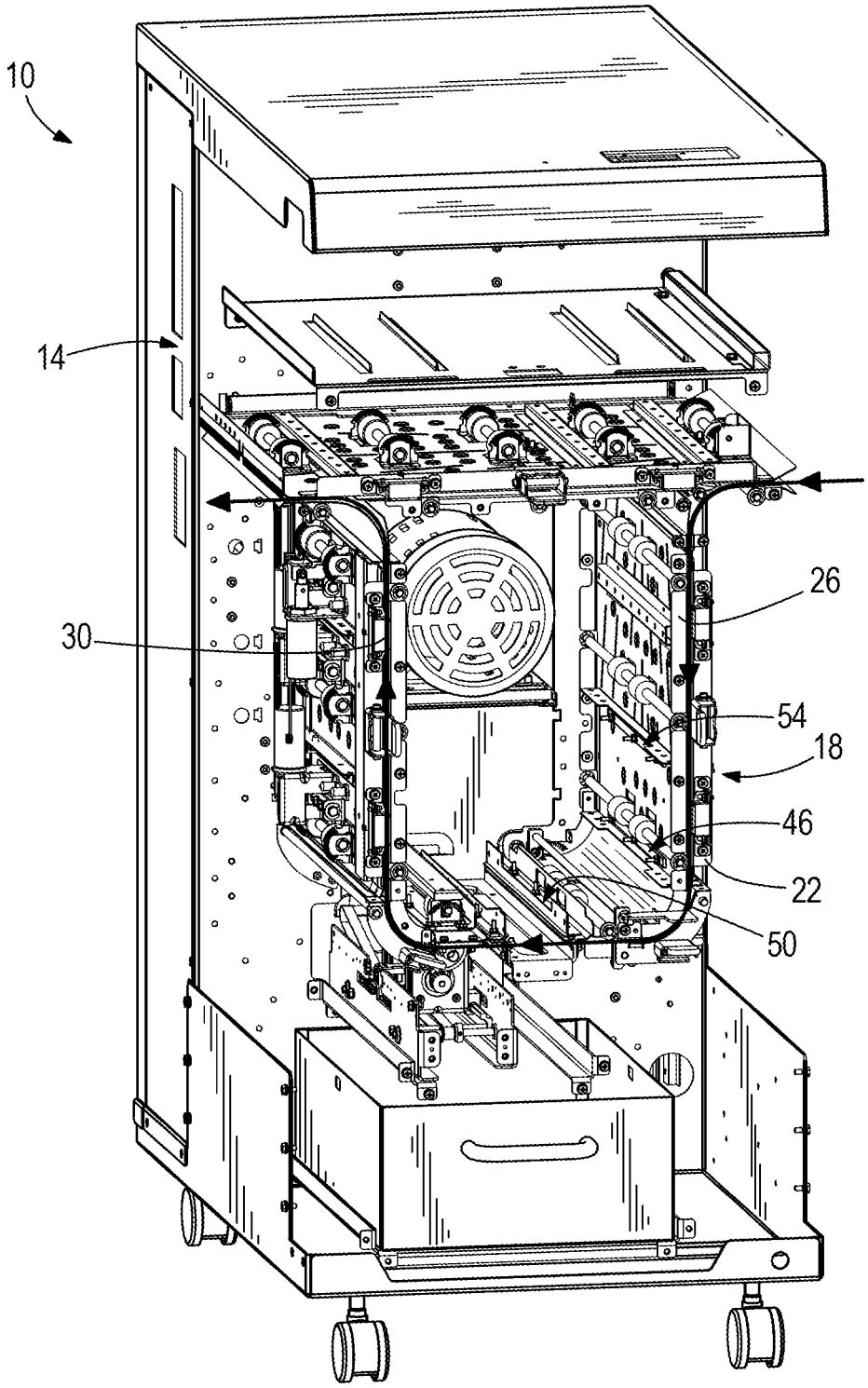
FIG. 2 is a partial perspective, sectional view of the material punching machine of FIG. 1, illustrating a direction of travel for a piece of material through the machine.

With reference to FIGS. 1 and 2, the machine 10 includes a housing 14 that at least partially surrounds a guide member 18. The illustrated guide member 18 is a U-shaped guide member 18, although other constructions include different shapes and sizes than that illustrated.

With reference to FIGS. 1-4, the guide member 18 includes a first U-shaped member 22 and a second U-shaped member 26 that together define a material pathway 30 therebetween. The guide member 18 includes a set of rollers 34 (FIGS. 3 and 4) that guide one or more pieces of material (e.g., pieces of paper) through the guide member 18 along a direction of travel as illustrated by the arrow in FIG. 2. The guide member 18 further includes a material receiving portion 38 and a material discharge portion 42 (FIG. 1) disposed at upper ends of the U-shaped guide member 18. The material receiving portion 38 receives the one or more pieces of material (e.g., from a printer or other device), and the material discharge portion 42 discharges the one or more pieces of material (e.g., into a tray or other storage medium, or to another post-processing device, such as a cutting and/or binding machine) after the one or more pieces of material have been moved through the material pathway 30. While the illustrated construction illustrates a particular direction of travel (i.e., moving right to left through a U-shaped path), in other constructions the direction of travel may be different from that illustrated.

Figure 4:
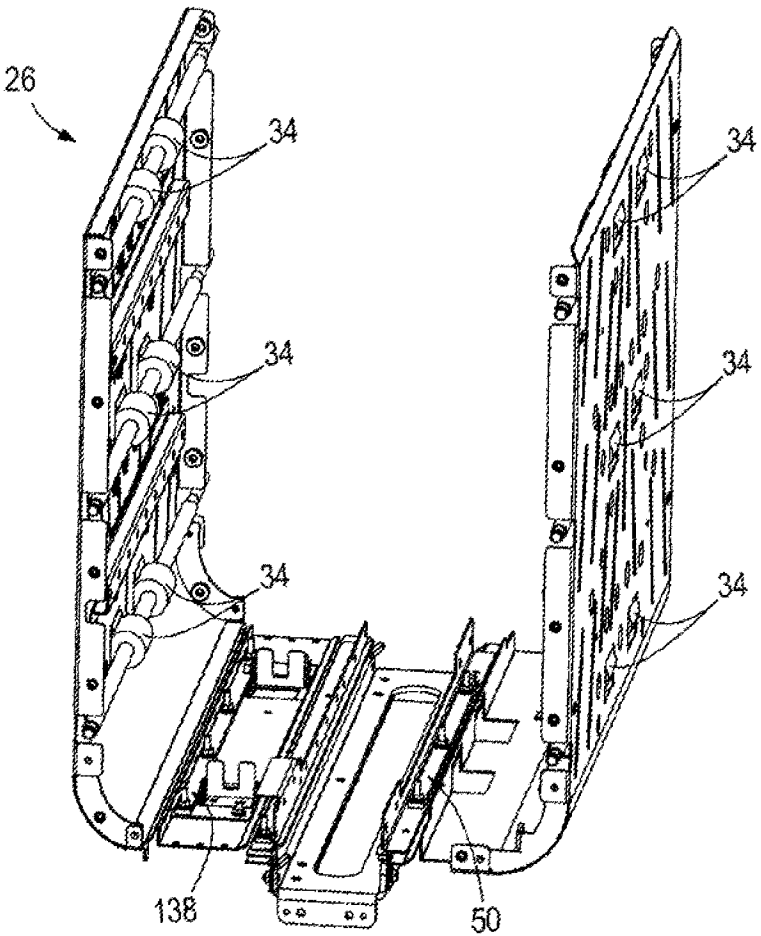
FIG. 4 is a perspective view of the portion of the guide member of FIG. 3, illustrating a leading edge sensor element.
Figure 3:
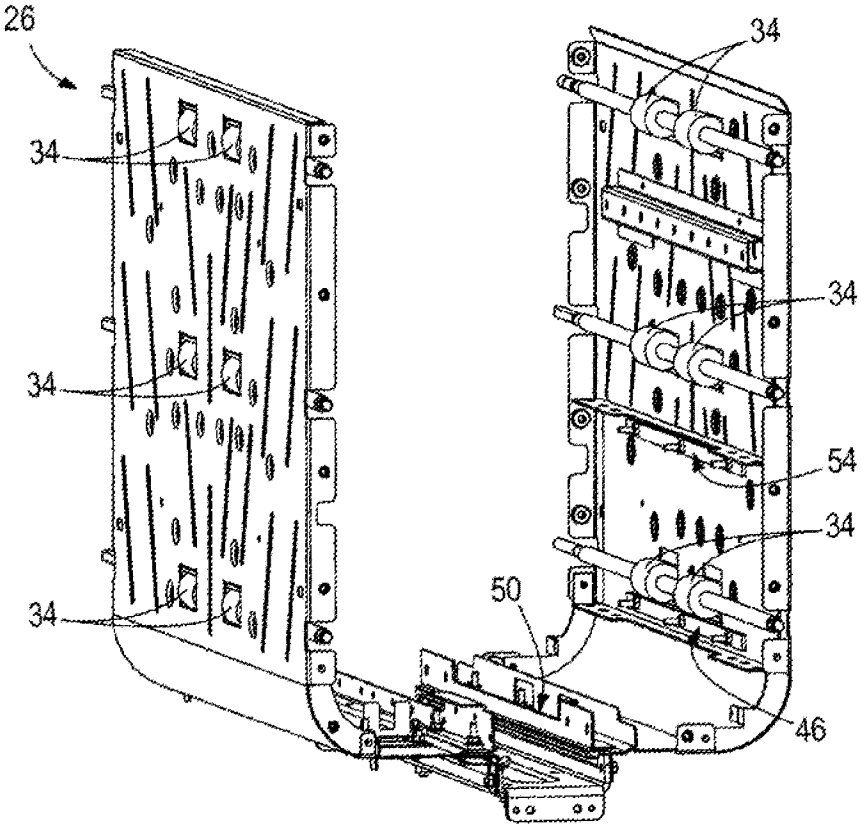
FIG. 3 is a perspective view of a portion of a guide member of the material punching machine of FIG. 1, illustrating first, second, and third trailing edge sensor elements.

With reference to FIGS. 2-4, the machine 10 includes a first trailing edge sensor element 46. The sensor element 46 is disposed adjacent the material pathway 30, and detects a first position of a trailing edge of a piece of material as the piece of material moves through the material pathway 30. The sensor element 46 includes a row of sensors (e.g., two sensors) arranged perpendicular to the direction of travel.

With continued reference to FIGS. 2-4, the machine 10 also includes a second trailing edge sensor element 50. The sensor element 50 is disposed adjacent the material pathway 30, and detects a second position of a trailing edge of the piece of material as the piece of material moves through the material pathway 30. The second position is different than the first position. The sensor element 50 includes a row of sensors (e.g., two sensors) arranged perpendicular to the direction of travel.

With continued reference to FIGS. 2-4, the machine 10 also includes a third trailing edge sensor element 54. The sensor element 54 is disposed adjacent the material pathway 30, and detects a first position of a trailing edge of a different piece of material as the different piece of material moves through the material pathway 30. The sensor element 54 includes a row of sensors (e.g., two sensors) arranged perpendicular to the direction of travel.

Figure 5:
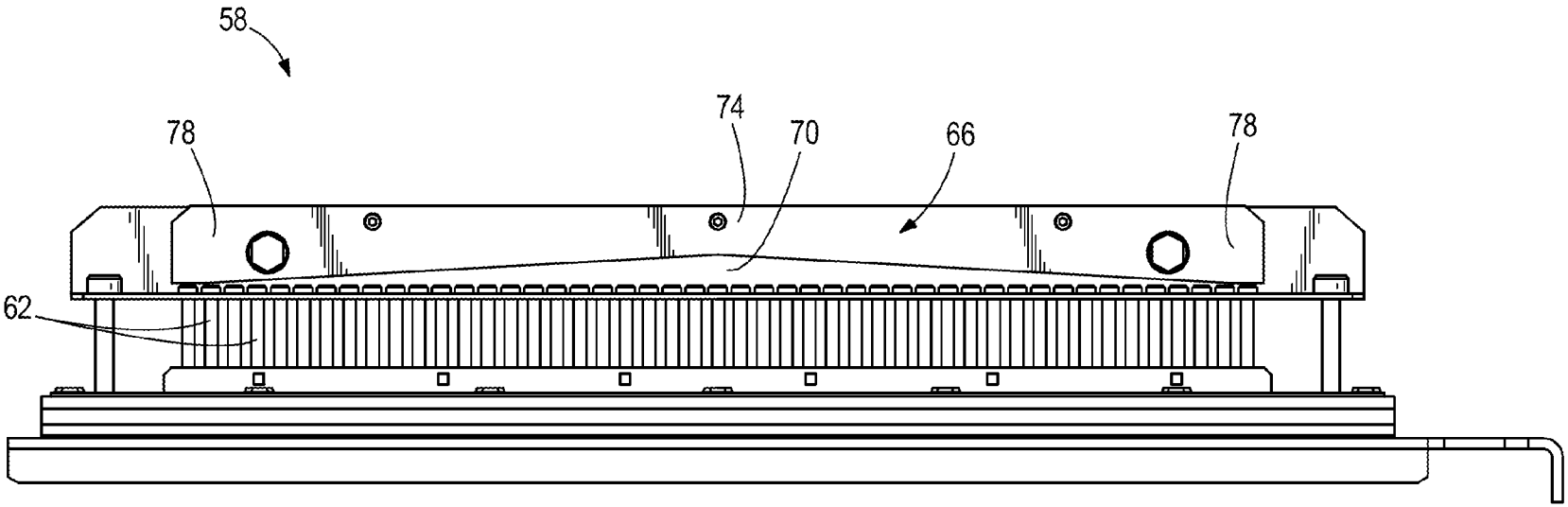
FIG. 5 is a front view of a punch element of the material punching machine of FIG. 1.
Figure 6:
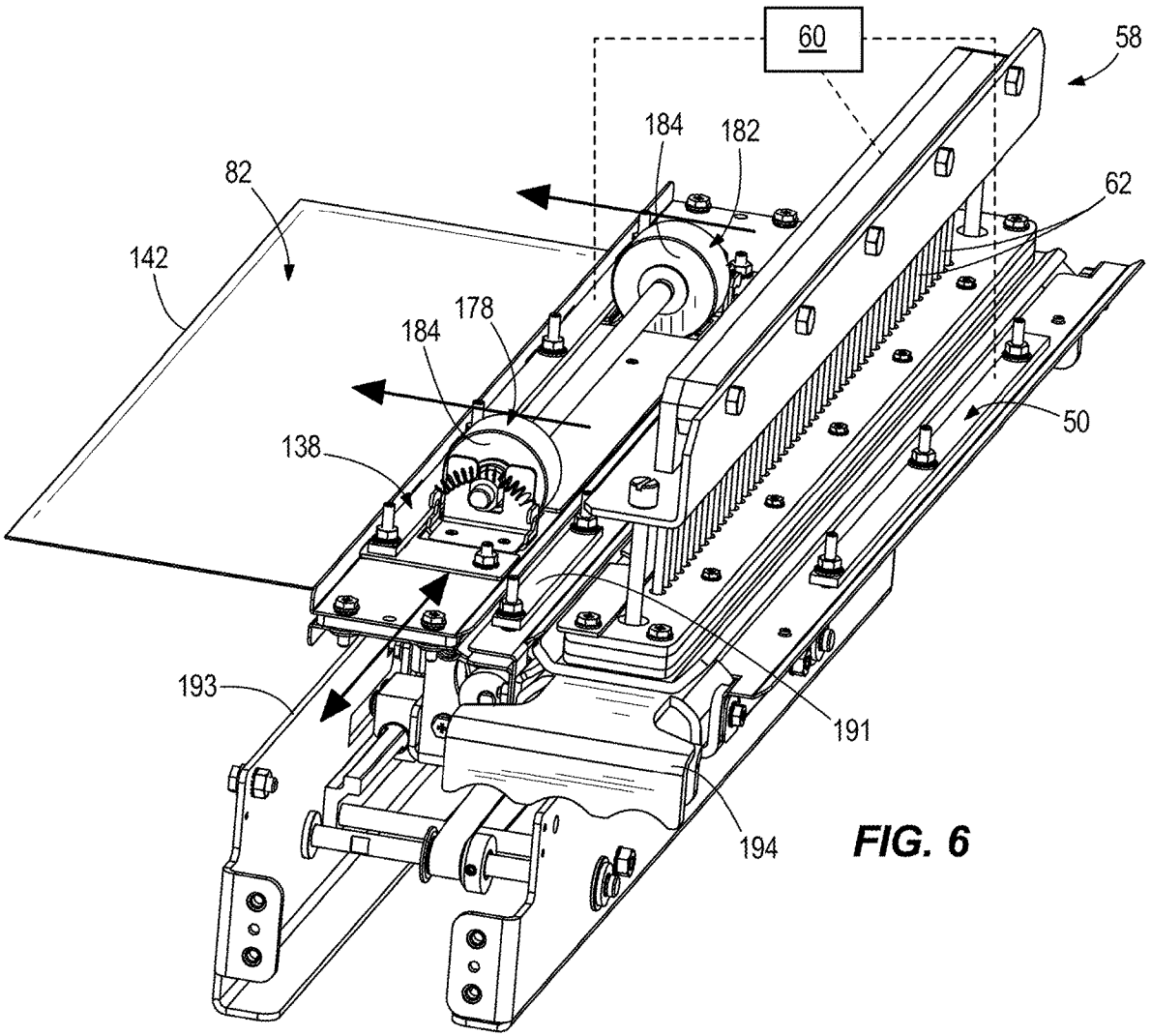
FIG. 6 is a perspective view of the punch element, the third trailing edge sensor element, the leading edge sensor element, and two steering elements.

With reference to FIGS. 1, 5, and 6, the machine 10 also includes a punch element 58. The punch element 58 is disposed generally at a bottom of the U-shaped guide member 18. The sensor elements 46, 50, and 54 are disposed between the punch element 58 and the material receiving portion 38, and are used to detect positions of trailing edges of different pieces of material passing through the material pathway 30, and to activate the punch element 58 to form one or more apertures in different areas of the pieces of material based on the detected positions of the trailing edges. Each of the sensor elements 46, 50, and 54 and the punch element 58 communicates with a controller 60 in the machine 10 (FIG. 6) such that the controller 60 can receive signals from the sensor elements 46, 50, and 54 (i.e., indicating detection of the trailing edges), and communicate a signal to the punch element 58 to actuate the punch element 58.

With reference to FIGS. 5 and 6, the illustrated punch element 58 is a paper punching die having a row of rectangular cross-section punch pins 62 extending perpendicular to the direction of travel of the piece of material. In other embodiments, the punch pins 62 can have other cross-sectional shapes, such as cylindrical. The punch element 58 includes a guide 66 disposed above the punch pins 62. The guide 66 is sized and configured to press down upon the punch pins 62 to direct the punch pins 62 in a downward direction toward the material pathway 30. The illustrated guide 66 includes a recessed area 70 generally in a middle portion 74 of the guide 66. The recessed area 70 causes outer ends 78 of the guide 66 to press down upon the punch pins 62 before the middle portion 74 presses down on the punch pins 62, thereby forcing punch pins 62 closer to the ends 78 to punch apertures into the piece of material before the punch pins 62 closer to the middle portion 74 punch apertures into the piece of material. This arrangement facilitates a reduction in the required punch force as apertures are formed in the ends of the piece of material first, as compared for example to a punch element 58 that presses all of the punch pins 62 down into the piece of material at the same time.

In some constructions the punch element 58 includes a plurality of dies with punch pins 62 and guides 66, each die arranged to punch its own separate set of apertures into a piece of material. The dies maybe operated together or separately.

With reference to FIGS. 1-6 and 8, the sensor elements 46 and 50 are positioned, sized, and configured to detect the trailing edge of a first piece of material 82 (FIGS. 6 and 8) as the first piece of material 82 moves along the direction of travel illustrated in FIGS. 2 and 6. The illustrated first piece of material 82 is a common 8.5"×11" piece of paper or size A4 piece of paper. Other constructions include different types of material and sizes for the first piece of material 82.

After the first piece of material 82 enters the material receiving portion 38, the first piece of material 82 travels through the material pathway 30. A trailing edge 86 of the first piece of material 82 passes over the sensor element 46. The sensor element 46 is positioned, sized, and configured to detect the trailing edge 86 when the punch element 58 is disposed generally above a middle portion 90 (FIG. 8) of the first piece of material 82. The sensor element 46 detects passage of the trailing edge 86, and based on detection of the trailing edge 86, the punch element 58 presses the punch pins 62 down into the middle portion 90 of the first piece of material 82, forming a row of apertures 94 (FIG. 8) into the middle portion 90.

As the first piece of material 82 travels farther through the material pathway 30, the trailing edge 86 passes over the sensor element 50. The sensor element 50 detects passage of the trailing edge 86, and based on detection of the trailing edge 86, the punch element 58 presses the punch pins 62 down adjacent the trailing edge 86, forming a row of apertures 98 (FIG. 8) into the first piece of material 82 adjacent the trailing edge 86.

A distance 102 between the row of apertures 98 and the row of apertures 94 is equal to half of an overall length 106 of the first piece of material 82, such that the row of apertures 94 is slightly offset from an exact center or middle of the first piece of material 82. This arrangement permits the first piece of material 82 to be cut in half after passing through the machine 10, with apertures 94 being disposed on one of the cut halves, and the apertures 98 being disposed on the other of the cut halves.

With reference to FIGS. 1-6 and 9, the sensor elements 54 and 50 are positioned, sized, and configured to detect the trailing edge of a second piece of material 110 (FIG. 9) as the second piece of material 110 moves along the direction of travel illustrated in FIG. 2. The illustrated second piece of material 110 is a common 11"×17" piece of paper or size A3 piece of paper. Other constructions include different types of material and sizes for the second piece of material 110.

After the second piece of material 110 enters the material receiving portion 38, the second piece of material 110 travels through the material pathway 30. A trailing edge 114 of the second piece of material 110 passes over the sensor element 54. The sensor element 54 detects passage of the trailing edge 114, and based on detection of the trailing edge 114, the punch element 58 presses the punch pins 62 down into a middle portion 118 of the second piece of material 110, forming a row of apertures 122 into the middle portion 118.

As the second piece of material 110 travels farther through the material pathway 30, the trailing edge 114 passes over the sensor element 50. The sensor element 50 detects passage of the trailing edge 114, and based on detection of the trailing edge 114, the punch element 58 presses the punch pins 62 down adjacent the trailing edge 114, forming a row of apertures 126 into the second piece of material 110 adjacent the trailing edge 114.

A distance 130 between the row of apertures 126 and the row of apertures 122 is equal to half of an overall length 134 of the second piece of material 110, such that the row of apertures 122 is slightly offset from an exact center or middle of the second piece of material 110. This arrangement permits the second piece of material 110 to be cut in half after passing through the machine 10, with apertures 122 being disposed on one of the cut halves, and the apertures 126 being disposed on the other of the cut halves.

In some constructions more than two sets of apertures 94, 98, 122, 126 are punched into a single sheet of material. With reference to FIG. 9A, in some constructions two or more sets of apertures 126, 122 are punched adjacent a centerline 136 of a second sheet of material 110A, such that the apertures 122 mirror the set of apertures 126 across the centerline 136. In some constructions three sets of apertures are formed into a single sheet of material, dividing the sheet of material into thirds. In some constructions more than three sets of apertures are formed. Various other locations and numbers of apertures are also possible.

Additionally, in some constructions only two trailing edge sensor elements (e.g., only the sensor elements 54 and 50) are used for the double punching of both the first piece of material 82 (e.g., the 8.5"×11" or A4 piece of paper) and the second piece of material 110 (e.g., the 11"×17" or A3 piece of paper). For example, once the trailing edge 86 of the first piece of material 82 passes the sensor 54, the first piece of material 82 is then moved through the material pathway 30 for a predetermined distance before the punching of the apertures 94 in the middle of the first piece of material 82. In contrast, when the trailing edge 114 of the larger, second piece of material 110 passes the sensor 54, the apertures 122 are punched immediately after, or soon after, detection of the trailing edge 114. While using only two trailing edge sensor elements is possible, the use of more than two trailing edge sensor elements (as illustrated with sensor elements 46, 50, and 54) provides greater accuracy and productivity.

The arrangement of the trailing edge sensor elements 46, 50, and 54 provides for detection of the trailing edges of differently-sized pieces of material, such as the illustrated first piece of material 82 and the second piece of material 110. The spacing of the sensor elements 46, 50, and 54 within the machine 10 facilitates the punching of apertures into more than one location on each of the differently-sized pieces of material. In some constructions the controller 60 can receive a signal indicative of the size of the piece of material being received by the material receiving portion 38 in order to selectively enable and/or process signaling from one of the two trailing edge sensor elements 46 or 54. In the illustrated construction, the trailing edge sensor 50 is utilized regardless of the size of the piece of material being processed.

In some constructions more than three trailing edge sensor elements are used to detect the trailing edges of more than two differently-sized pieces of material. For example, in some constructions the machine 10 includes four trailing edge sensor elements disposed adjacent the material pathway 30 that detect the trailing edge positions of three differently-sized pieces of material passing through the material pathway 30. Other constructions include different numbers of sensor elements. In some constructions one or more of the sensor elements described above are used to detect leadings edges, rather than trailing edges, of one or more pieces of material. For example, the sensor elements, in combination with one or more punch dies, may be used to punch apertures adjacent the leading edges, as opposed to the trailing edges, along the pieces of material.

With reference to FIGS. 4, 6, and 10-13, the machine 10 is configured to align and/or straighten (e.g., de-skew) a piece of material as the piece of material passes through the material pathway 30. The machine 10 includes a leading edge sensor element 138. The sensor element 138 is disposed adjacent the material pathway 30, and detects a leading edge of a piece of material as the piece of material moves through the material pathway 30.

Figure 9:
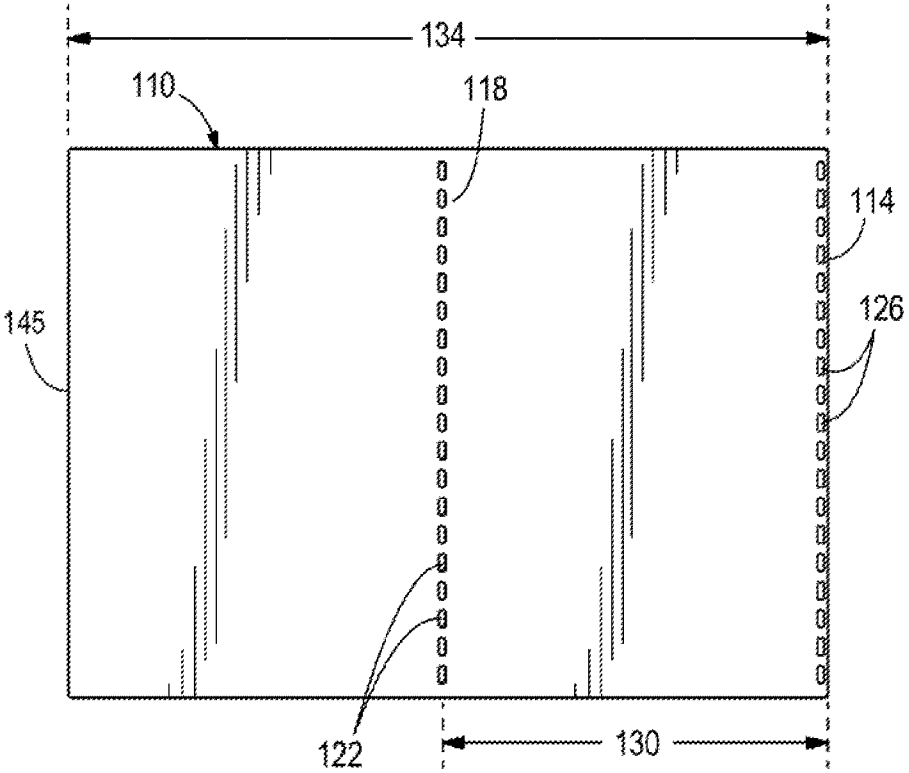
FIG. 9 is a top view of a second piece of material that has passed through the material punching machine of FIG. 1, with an arrangement of apertures.
Figure 8:
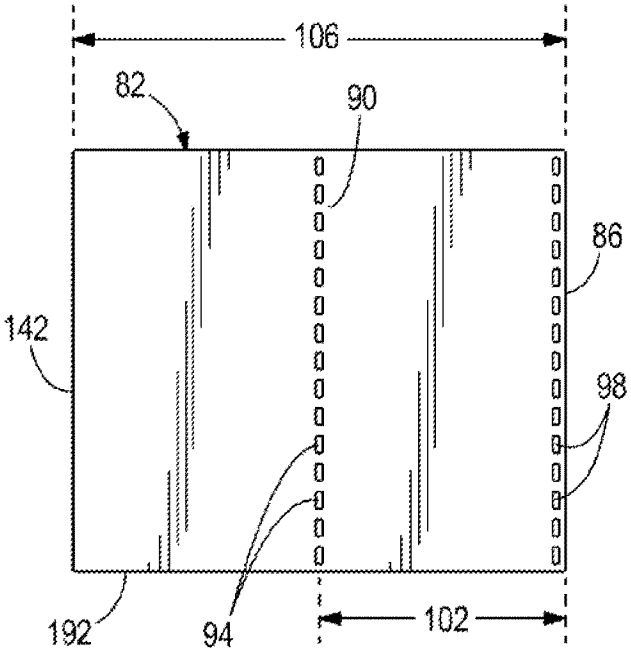
FIG. 8 is a top view of a first piece of material that has passed through the material punching machine of FIG. 1, with an arrangement of apertures.
Figure 9A:
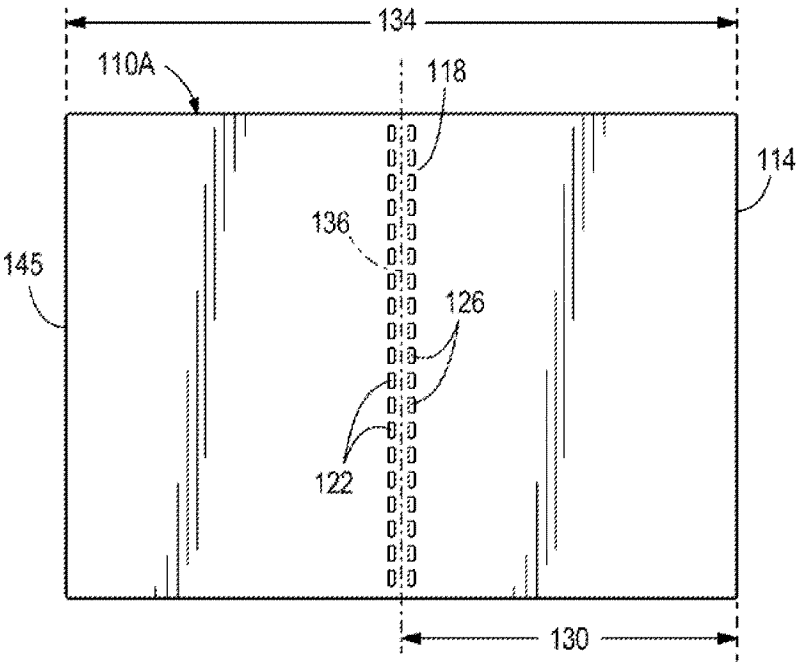
FIG. 9A is a top view of the second piece of material, with a different arrangement of apertures.

With reference to FIGS. 6, 8, and 9, the sensor element 138 detects a leading edge 142 of the first piece of material 82 and a leading edge 145 of the second piece of material 110 as the first and second pieces of material 82, 110 pass through the material pathway 30. As illustrated in FIG. 6, the sensor element 138 is disposed on an opposite side of the punch element 58 as that of the sensor element 50.

Figure 10:
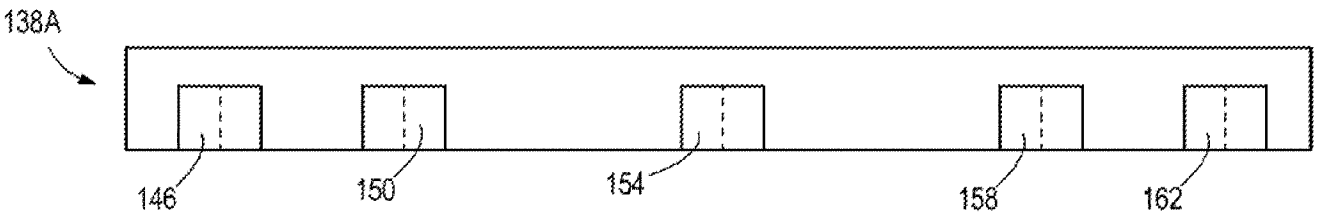
FIG. 10 is a schematic illustration of the leading edge sensor element.
Figure 11:
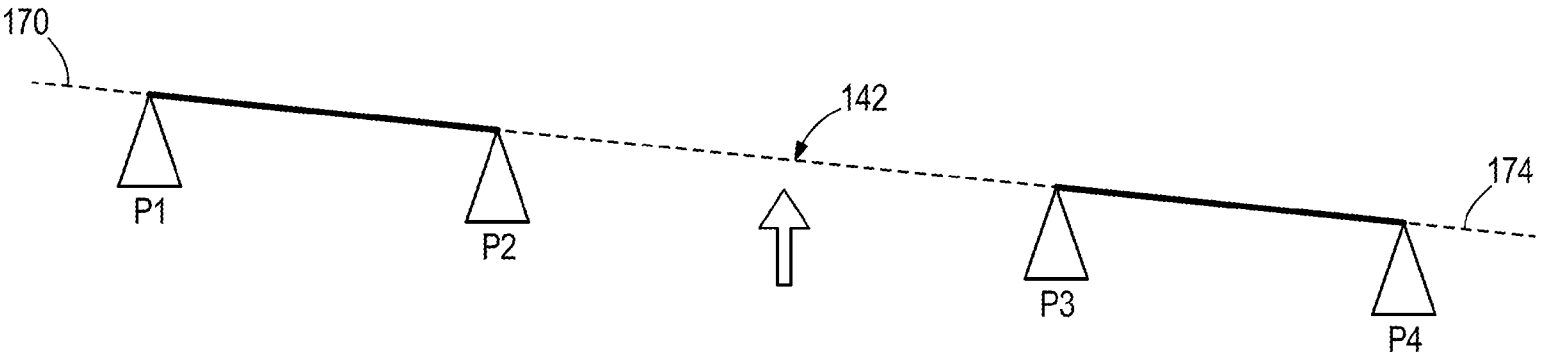
FIG. 11 is a schematic illustration of positions detected by the leading edge sensor element on the first piece of material.
Figure 12:
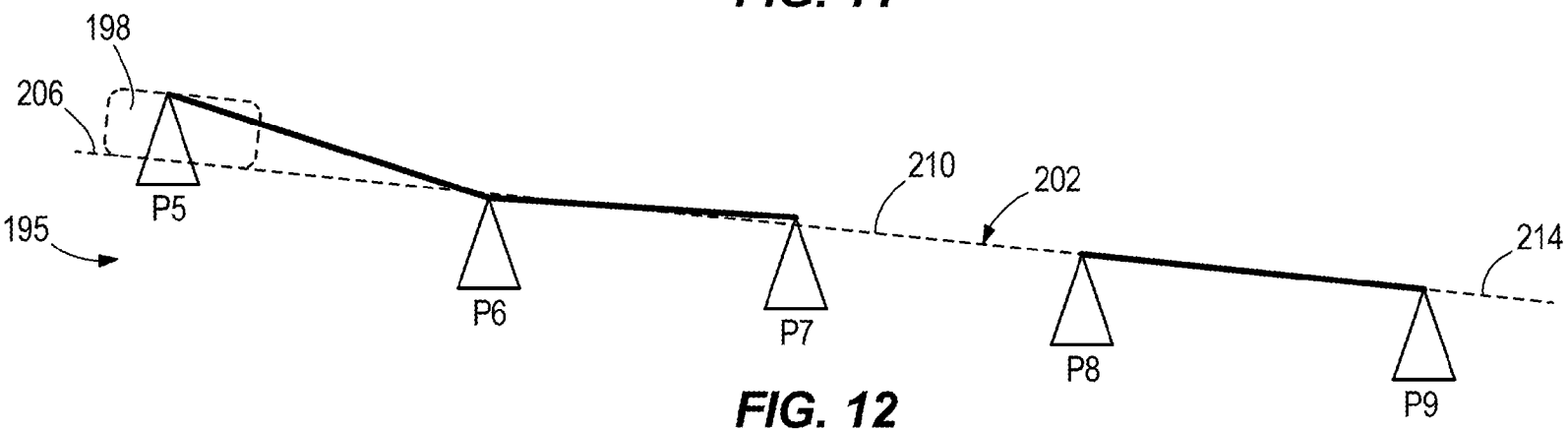
FIG. 12 is a schematic illustration of positions detected by the leading edge sensor element on a tabbed piece of material.

With reference to FIGS. 10-12, an embodiment of the sensor element 138 (illustrated as 138A in FIG. 10) includes five separate sensors 146, 150, 154, 158, and 162. The sensors 146, 150, 154, 158, and 162 are arranged in a row perpendicular to the direction of travel of the piece of material. The sensors 146 and 162 are sized and spaced such that they detect a position of the leading edge (e.g., the leading edge 142) of a piece of material near ends of the leading edge. The sensors 150 and 158 are sized and spaced such that they detect a position of the leading edge of the piece of material inwardly of the sensors 146 and 162. The sensor 154 is sized and spaced such that it detects a position of the leading edge of the piece of material near a center of the leading edge that is inward of the sensors 146, 150, 158, and 162.

With reference to FIGS. 11 and 12, a piece of material is almost always misaligned to at least some degree within the machine 10 and the material pathway 30. For example, and with reference to FIG. 11, the leading edge 142 of the first piece of material 82 may become skewed, such that a first end 170 of the leading edge 142 is spaced slightly ahead of a second end 174 of the leading edge 142 in relation to the direction of travel (illustrated by the arrow in FIG. 11). In this arrangement, the first end 170 will pass across the sensor element 138 before the second end 174. The sensor 146 will detect the first end 170 of the leading edge 142 passing across the sensor element 138. After some time has passed, the sensor 150 will then detect the leading edge 142. After some additional time has passed, the sensor 154 will then detect the leading edge 142. After some additional time has passed, the sensor 158 will then detect the leading edge 142.

After some additional time has passed, the sensor 162 will then detect the second 174 of the leading edge 142.

The machine 10 (i.e., the controller 60 in the machine 10) uses the information from two or more of the sensors 146, 150, 154, 158, and 162 to calculate positions of the leading edge. For example, and with continued reference to FIG. 11, the sensor 146 detects a measurement position P1 of the leading edge 142 of the first piece of material 82. The sensor 150 detects a measurement position P2 of the leading edge 142. The sensor 158 detects a measurement position P3 of the leading edge 142. The sensor 162 detects a measurement position P4 of the leading edge 142. Based on the detected measurement positions P1, P2, P3, P4, the machine 10 (i.e., the controller 60 in the machine 10) is configured to calculate the orientation and positioning of the leading edge 142 relative to the direction of travel.

If the orientation and positioning of the leading edge 142 is outside of a predetermined value or range of values (e.g. is too skewed or tilted relative to the direction of travel), the machine 10 is configured to adjust the orientation and positioning of the leading edge 142. For example, and with reference to FIGS. 6, 7, and 13, the machine 10 includes steering elements 178 and 182. The illustrated steering elements 178 and 182 each include two rollers 184 (FIG. 7) disposed adjacent the sensor element 138. One roller 184 is disposed above the material pathway 30 and one roller 184 is disposed below the material pathway 30, such that the first piece of material 82 (or other material) passes between the rollers 184 on each steering element 178, 182. Each of the steering elements 178 and 182 is independently operable to move a portion of a piece of material at varying speeds. While two steering elements 178, 182 are illustrated, in some constructions other numbers of steering elements 178, 182 are used. In some constructions the steering elements 178, 182 include structures other than rollers 184.

Figure 7:
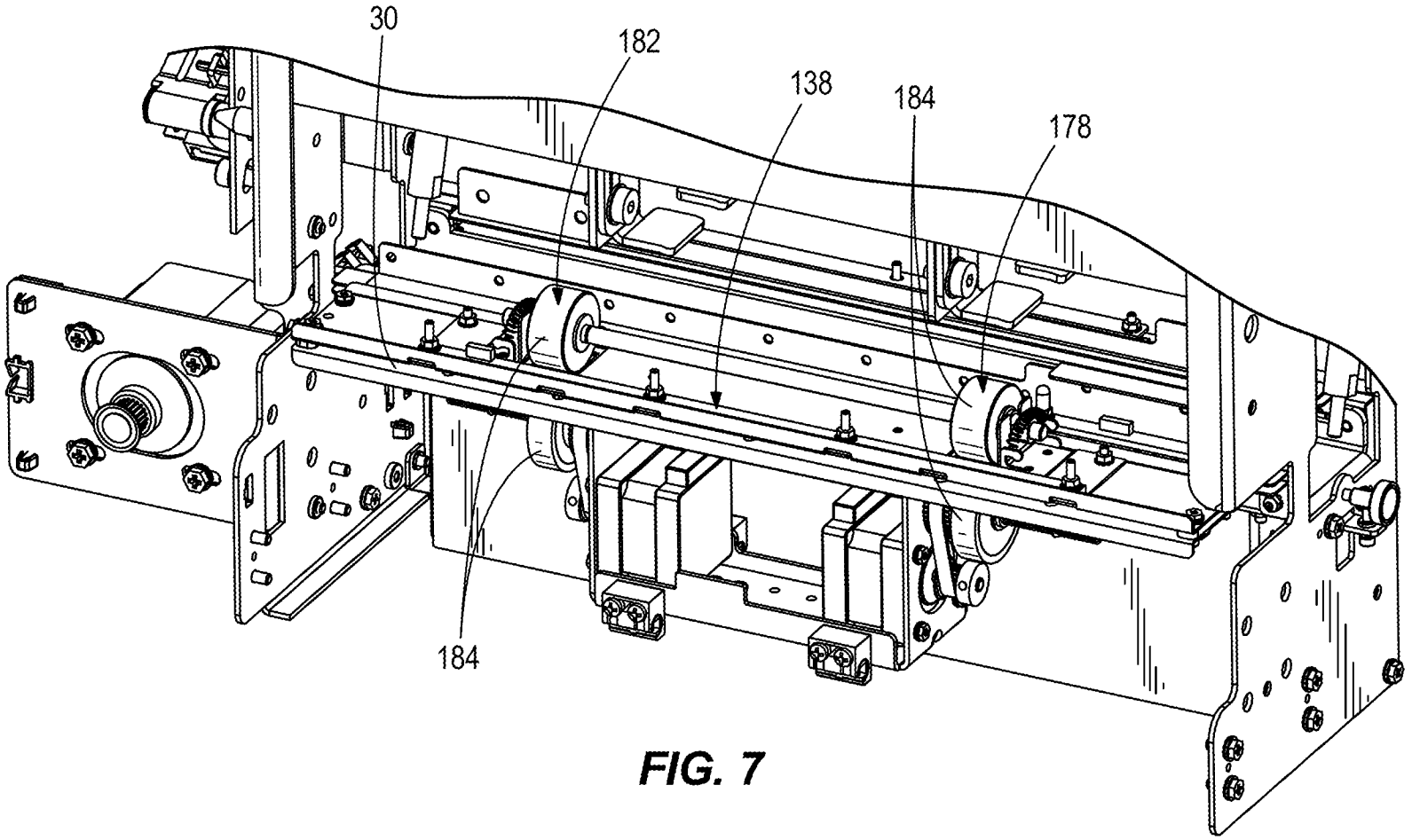
FIG. 7 is a perspective view of the two steering elements.

With reference to FIGS. 6, 7, and 11, if the leading edge 142 of the first piece of material 82 requires adjustment, the steering elements 178 and 182 are used to adjust the orientation and positioning of the leading edge 142. The steering elements 178 and 182 are normally operating at the same speed (e.g., the rollers 184 are rotating at the same speed on each steering element 178, 182) to help facilitate motion of the first piece of material 82 through the material pathway 30. When the leading edge 142 passes across the sensor element 138, the sensors 146, 150, 158, and 162 detect the measurement positions P1, P2, P3, and P4 of the leading edge 142. Based on these measured values, the machine 10 (i.e., the controller 60 in the machine 10) determines whether the leading edge 142 is skewed.

To correct the skew illustrated in FIG. 11, either the steering element 178 is slowed down for a predetermined time while the steering element 182 continues to operate at normal speed, or the steering element 182 is sped up while the steering element 178 continues to operate at normal speed. During this de-skewing operation, the second end 174 of the leading edge 142 is pushed forward at a faster rate than the first end 170. In some constructions the first end 170 remains stationary while the second end 174 is pushed forward. The steering element 182 continues to push the second end 174 forward until the entire leading edge 142 is at least generally aligned along a direction parallel to the sensor element 138 and perpendicular to the direction of travel. The controller 60 is programmed to adjust the relative speeds of the steering elements 178 and 182 based on an observed skew in the material to eliminate the skew and re-align the material.

Figure 13:
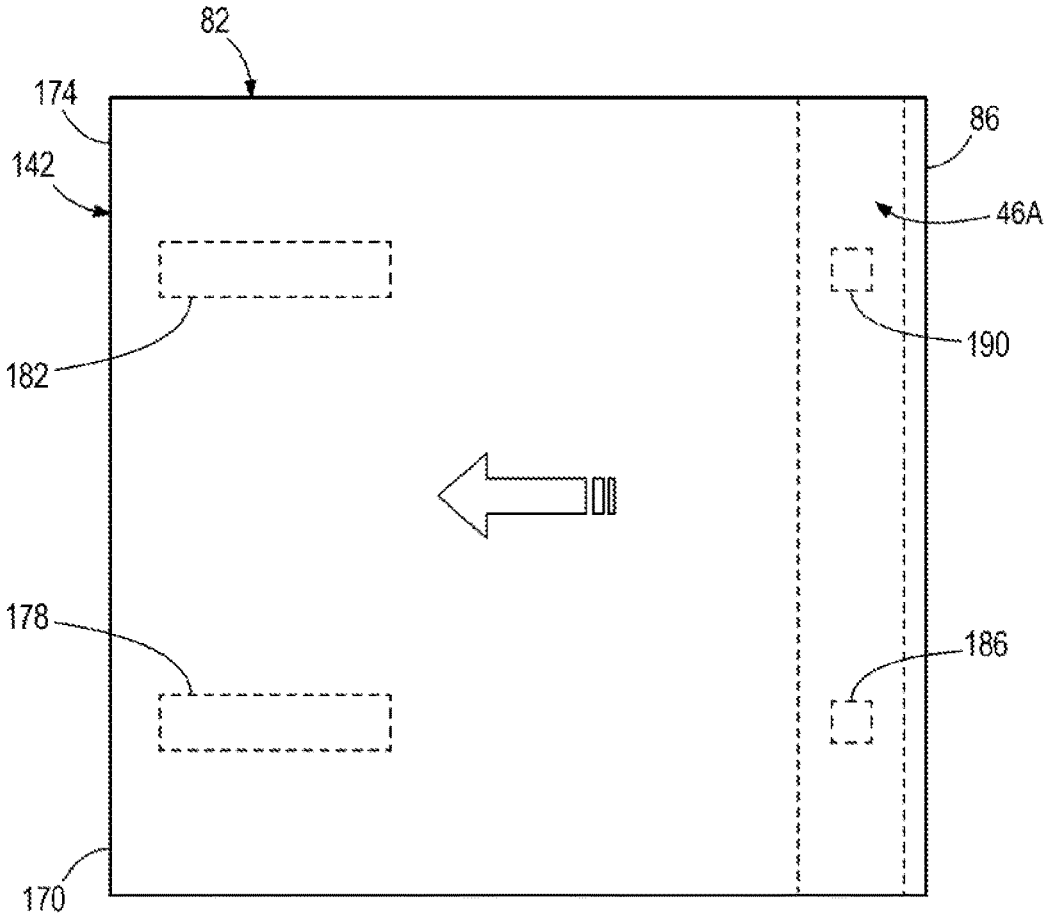
FIG. 13 is a schematic, top view of the first piece of material after a first adjustment using the leading edge sensor element.

With reference to FIG. 13, the machine 10 is configured to further adjust the orientation and positioning of the first piece of material 82 a second time by utilizing the sensor element 46. As illustrated in FIG. 13, an embodiment of the sensor element 46 (illustrated as 46A in FIG. 13) includes two sensors 186 and 190. The sensors 186 and 190 are arranged in a row perpendicular to the direction of travel (as illustrated by the arrow in FIG. 13). The sensors 186 and 190 detect positions of the trailing edge 86 of the first piece of material 82 as the trailing edge 86 passes over the sensors 186 and 190. The machine 10 uses the measurement positions of the trailing edge 86 (as detected by the sensors 186 and 190), similar to the way in which the machine 10 uses the measurement positions P1, P2, P3, and P4 of the leading edge 142, to determine the orientation and positioning of the trailing edge 86 (and consequently the orientation and positioning of the leading edge 142, assuming the leading edge 142 and the trailing edge 86 are parallel). This second de-skewing operation occurs at a slower rate to ensure greater accuracy. In some constructions the second de-skewing operation is performed at a higher speed, though with some compromised accuracy.

The machine 10 determines whether the trailing edge 86 is misaligned. If the trailing edge 86 is misaligned, one or more of the steering elements 178, 182 are used again to adjust the orientation and positioning of the first piece of material 82, but this time at a slower rate. For example, the steering element 178 is stopped, and the steering element 182 is operated at a slower speed than during the first adjustment. During this second adjustment, the rollers 184 on the steering element 182 are rotated a set number of steps or degrees to fine-tune the adjustment of the first piece of material 82.

With reference to FIGS. 6 and 8, as the first piece of material 82 passes between the sensor element 50 and the sensor element 138, a further sensor element 191 is also used to detect a lateral positioning of the piece of material 82. The sensor element 191 includes a plurality of sensors (e.g., five sensors) that detect positions of a side edge 192 of the first piece of material 82. As the first piece of material 82 passes through the material pathway 30, it almost always becomes misaligned to at least some degree in a lateral direction (as illustrated by the double-headed arrow in FIG. 6), the lateral direction being perpendicular to the direction of travel (illustrated by the two separate arrows in FIG. 6). To correct this lateral misalignment, the steering elements 178, 182 (along with the sensor element 138) are built on a sliding carriage 193 that slides laterally back and forth relative to a fixed frame 194. The fixed frame 194 includes the punch element 58 and the sensor element 50. When a misalignment of the side edge 192 is detected, the controller 60 actuates movement of the sliding carriage 193 to bring the first sheet of material 82 (or any other sheet of material) back into a proper alignment with the punch element 58.

The various adjustments of the first piece of material 82 described above are performed prior to the punching of the first set of apertures 94. Thus, the machine 10 uses the sensor elements 138, 46, and 191, in combination with the steering elements 178, 182, to properly align the first piece of material 82 before the first set of apertures 94 is punched. The apertures 94 are punched with the piece of material 82 held stationary (e.g., with all rollers stopped). Once the apertures 94 are punched, the first piece of material 82 is then moved (e.g., accelerated) further along the material pathway 30, until the sensor element 50 detects the trailing edge 86. The sensor elements 50, 191 determine whether the first piece of material 82 is still aligned, or whether any additional misalignment has occurred. The sensor element 50 includes sensors similar to the sensors 186, 190 in sensor element 46. If the first piece of material 82 is misaligned, the steering elements 178, 182, along with the sliding carriage 193, are used again to align the first piece of material 82. With the first piece of material 82 aligned, the second set of apertures 98 is then punched. A similar process occurs with the second piece of material 110 (e.g., aligning the piece of material 110 with the sensor elements 138, 54 and the steering elements 178, 182 and sliding carriage 193, punching the first set of apertures 122, aligning the piece of material 110 again with the sensor elements 50 and 191, the sliding carriage 193, and the steering elements 178, 182, and then punching the second set of apertures 126.

In some constructions only the apertures 98, 126 adjacent the trailing edges 86, 114, respectively, are punched in the first piece of material 82 and the second piece of material 110. In these constructions the alignment process only uses the sensor elements 138, 50, and 191 to align the pieces of material 82, 110 prior to punching the apertures 98, 126.

With reference to FIG. 12, the machine is also sized and configured to determine whether a tabbed piece of material is passing through the material pathway 30, and whether the tabbed piece of material requires adjustment of its orientation and positioning.

For example, and as illustrated in FIG. 12, a piece of material 195 (e.g., a piece of paper) passing through the material pathway 30 may include one or more tabs 198. In the illustrated construction, the piece of material 195 includes a single tab 198 disposed along a leading edge 202. The tab 198 is disposed at a first end 206 of the leading edge 202. The leading edge 202 further includes a middle portion 210 and a second end 214.

With reference to FIGS. 10 and 12, as the piece of material 195 passes over the sensors 146, 150, 154, 158, and 162, the sensors 146, 150, 154, 158, and 162 detect positions P5, P6, P7, P8, and P9, respectively, of the leading edge 202. Based on these measured values, the machine 10 determines whether the leading edge 202 is skewed. The machine 10 is configured to account for the tab 198. Specifically, the machine 10 looks for a plurality of positions that are aligned linearly, indicating a portion of the leading edge 202 that does not include a tab. For example, if the machine determines that the positions P6, P7, P8, and P9 are aligned linearly, the machine 10 disregards the position P5, and bases the alignment of the leading edge 202 solely on the positions P6, P7, P8, and P9. If the alignment is skewed, as illustrated in FIG. 12, the machine 10 then corrects the skew.

To correct the skew of the leading edge 202, the steering elements 178 and 182 are used similar to the method described above with the first piece of material 82. For example, the steering element 178 is stopped for a predetermined time while the steering element 182 continues to operate. As the steering element 182 continues to operate, the second end 214 of the leading edge 202 is pushed forward at a faster rate than the first end 206. In some constructions the first end 206 remains stationary while the second end 214 is pushed forward. The steering element 182 continues to push the second end 214 forward until the leading edge 202 (disregarding the tab 198) is at least generally aligned along a direction parallel to the sensor element 138 and perpendicular to the direction of travel. The sensor 191 and sliding carriage 193 are also used to correct for lateral misalignment.

The sensors 186 and 190 are also used to perform a second, fine-tuning adjustment, similar to the fine-tuning adjustment on the first piece of material 82 described above. For example, the machine 10 uses the positions of a trailing edge of the tabbed piece of material 195 to determine the orientation and positioning of the trailing edge (and consequently the orientation and positioning of the leading edge 202, assuming the leading edge 202 and the trailing edge are parallel). The machine 10 determines whether the trailing edge is misaligned at one or more times (depending on whether one or multiple sets of apertures are to be punched). If the trailing edge is misaligned, one or more of the steering elements 178, 182 are used again to correct the orientation, but this time at a slower rate. For example, the steering element 178 is stopped, and the steering element 182 is operated at a slower speed than during the first adjustment. During this second adjustment, the rollers 184 on the steering element 182 are rotated a set number of steps or degrees to fine-tune the adjustment of the piece of material 195.

While the adjustments and de-skewing described above are described in conjunction with the multiple punching of apertures into a piece of material, in some constructions the adjustments and de-skewing are used in conjunction with only a single punching of apertures into a piece of material, or with no punching of apertures into a piece of material. Additionally, in some constructions the single or multiple punching of apertures described above is performed without any adjustments or de-skewing.

Various features and advantages of the invention are set forth in the following claims.

What is claimed is:

1. A punching machine comprising:

a guide member defining a material pathway for transporting a piece of material through the machine;

a first sensor element disposed adjacent the material pathway for detecting a first position of an edge of the piece of material as the piece of material moves through the material pathway;

a second sensor element disposed adjacent the material pathway for detecting a second position of the edge of the piece of material as the piece of material moves through the material pathway; and a punch element that punches a first aperture in the piece of material in a first area of the piece of material based on detection of the edge by the first sensor, and subsequently punches a second aperture in another area of the piece of material based on detection of the edge by the second sensor, wherein the punch element punches the first aperture prior to detection of the edge by the second sensor.

2. The material punching machine of claim 1, further comprising a third sensor element disposed adjacent the material pathway for detecting a position of an edge of a differently-sized piece of material.

3. The material punching machine of claim 1, wherein the punch element is sized and configured to punch a first row of apertures in a middle portion of the piece of material when the first sensor element detects the edge.

4. The material punching machine of claim 3, wherein the punch element is sized and configured to punch a second row of apertures adjacent the edge of the piece of material when the second sensor element detects the edge.

5. The material punching machine of claim 1, wherein the material pathway defines a direction of travel for the piece of material, and wherein the first sensor element includes a row of sensors arranged perpendicular to the direction of travel.

6. The material punching machine of claim 1, wherein the material pathway defines a direction of travel for the piece of material, and wherein the second sensor element includes a row of sensors arranged perpendicular to the direction of travel.

7. The material punching machine of claim 1, wherein the material pathway defines a direction of travel for the piece of material, and wherein the punch element includes a punch die having a row of punch pins arranged perpendicular to the direction of travel.

8. The material punching machine of claim 7, wherein the first sensor element is positioned to detect a trailing edge of the piece of material when the punch element is disposed above a middle portion of the piece of material.

9. The material punching machine of claim 1, wherein the guide member is U-shaped.

10. The material punching machine of claim 9, wherein the guide member includes a material receiving portion and a material discharge portion at upper ends of the U-shaped guide member.

11. The material punching machine of claim 10, wherein the first and second sensor elements are disposed between the punch element and the material receiving portion.

12. The material punching machine of claim 1, further comprising steering rollers and a controller, wherein the controller is configured to activate one or more of the steering rollers to correct for misalignment of the piece of material prior to the punch element punching the first aperture in the piece of material.

13. The paper punching machine of claim 1, wherein the piece of material is configured to move along a direction within the material pathway, and wherein the second sensor is disposed downstream of the first sensor along the direction.

14. A paper punching machine comprising:

a U-shaped guide member including a first member, a second member, and a set of rollers, the first and second members defining a material pathway therebetween for transporting a piece of paper along a direction of travel, wherein the rollers are sized and configured to engage the piece of paper to transport the piece of paper through the guide member;

a first sensor element disposed adjacent the material pathway for detecting a trailing edge of the piece of paper a first time as the piece of paper moves through the material pathway, the first sensor element including a plurality of sensors arranged in a row perpendicular to the direction of travel;

a second sensor element disposed adjacent the material pathway for detecting the trailing edge of the piece of paper a second time as the piece of paper moves through the material pathway; and a punch element including a plurality of punch pins sized to punch a first set of apertures in the piece of paper in a middle portion of the piece of paper based on detection of the trailing edge by the first sensor, and to subsequently punch a second set of apertures in the piece of paper adjacent the trailing edge based on detection of the trailing edge by the second sensor, wherein the punch element punches the first set of apertures prior to detection of the trailing edge by the second sensor.

15. The paper punching machine of claim 14, further comprising a third sensor element disposed adjacent the material pathway for detecting a position of a trailing edge of a differently-sized piece of paper.

16. The paper punching machine of claim 15, wherein the third sensor element is sized and configured to detect the trailing edge of the differently-sized piece of paper when the punch element is disposed above a middle portion of the differently-sized piece of paper.

17. The paper punching machine of claim 14, wherein the first sensor element is positioned to detect the trailing edge of the piece of paper when the punch element is disposed above the middle portion of the sheet of paper.

18. The material punching machine of claim 14, wherein the U-shaped guide member includes a material receiving portion at one end of the guide member, wherein the punch element is disposed at a bottom of the guide member, and wherein the first and second sensor elements are disposed between the punch element and the material receiving portion.

19. The paper punching machine of claim 14, wherein the second sensor is disposed downstream of the first sensor along the direction of travel.

20. A method of operating a punching machine comprising:

directing a piece of material along a direction through a material pathway in the machine;

detecting an edge of the piece of material a first time with a first sensor disposed adjacent the material pathway;

punching a first set of apertures into the piece of material based on detection of the edge with the first sensor;

detecting the edge of the piece of material a second time with a second sensor disposed adjacent the material pathway, subsequent to punching the first set of apertures; and punching a second set of apertures in the piece of material based on detection of the edge with the second sensor, subsequent to detecting the edge of the piece of material the second time with the second sensor.

21. The method of claim 20, wherein the step of punching the first set of apertures includes punching a set of apertures in a middle portion of the piece of material, and wherein the step of punching the second set of apertures includes punching a set of apertures adjacent a trailing edge of the piece of material, wherein the piece of material includes a leading edge, wherein the middle portion of the piece of material is between the trailing edge and the leading edge along the direction, and wherein a distance between the first set of apertures and the second set of apertures is half of an overall length of the piece of material measured between the leading edge and the trailing edge.

22. The method of claim 20, further comprising calculating a first misalignment of the piece of material using the first sensor, and using a set of steering rollers to correct the first misalignment prior to punching the first set of apertures, and calculating a second misalignment of the piece of material using the second sensor, and using the steering rollers to correct the second misalignment prior to punching the second set of apertures.

23. The method of claim 20, wherein the second sensor is disposed downstream of the first sensor along the direction.

* * * * *